US010859935B2

(12) United States Patent
Ohtsu et al.

(10) Patent No.: US 10,859,935 B2
(45) Date of Patent: Dec. 8, 2020

(54) TONER

(71) Applicant: CANON KABUSHIKI KAISHA, Tokyo (JP)

(72) Inventors: Takeshi Ohtsu, Toride (JP); Tadashi Fukuda, Tokyo (JP); Mikihiro Akasaki, Matsudo (JP); Akinori Miyamoto, Bando (JP); Kota Mori, Abiko (JP); Masami Hano, Abiko (JP); Takashi Kase, Tokyo (JP); Daisuke Tsujimoto, Tokyo (JP); Ryuichiro Matsuo, Moriya (JP); Kazuto Hosoi, Abiko (JP); Yoshihiro Ogawa, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/550,452

(22) Filed: Aug. 26, 2019

(65) Prior Publication Data

US 2020/0073266 A1 Mar. 5, 2020

(30) Foreign Application Priority Data

Aug. 28, 2018 (JP) ..... 2018-159788
Dec. 28, 2018 (JP) ..... 2018-247559

(51) Int. Cl.
*G03G 9/08* (2006.01)
*G03G 9/097* (2006.01)
*G03G 9/087* (2006.01)

(52) U.S. Cl.
CPC ..... *G03G 9/09716* (2013.01); *G03G 9/0819* (2013.01); *G03G 9/0823* (2013.01);
(Continued)

(58) Field of Classification Search
CPC . G03G 9/097; G03G 9/09708; G03G 9/09716
(Continued)

(56) References Cited

U.S. PATENT DOCUMENTS 5,750,302 A 5/1998 Ogawa et al.
5,858,593 A 1/1999 Tamura et al.
(Continued)

FOREIGN PATENT DOCUMENTS

EP 1 975 727 10/2008
EP 2 192 448 6/2010
(Continued)

OTHER PUBLICATIONS

U.S. Appl. No. 16/526,501, Nobuyoshi Sugahara, filed Jul. 30, 2019.
(Continued)

*Primary Examiner* — Mark A Chapman
(74) *Attorney, Agent, or Firm* — Venable LLP

(57) ABSTRACT

A toner includes toner particle containing at least a strontium titanate particle on the surface of the toner particle, and the toner is a water-washed toner from which strontium titanate particle desorbable by water washing are removed by water washing. The water-washed toner contains the strontium titanate particle having a number average particle diameter of primary particle (D1) of 10 nm or more and 150 nm or less, and when the distribution of an Sr element in the water-washed toner in the depth direction is determined, (i) the Sr element abundance on the outermost surface x satisfying $0.00<x\leq0.80$, and (ii) the difference between x and xp "xp−x" satisfying $0.00<xp-x\leq0.95$, where xp is the maximum peak value (atomic %) of the Sr element abundance in the region from the outermost surface to 50 nm.

8 Claims, 1 Drawing Sheet

(52) U.S. Cl.
CPC ..... *G03G 9/08755* (2013.01); *G03G 9/097* (2013.01); *G03G 9/09708* (2013.01)

(58) Field of Classification Search
USPC ..... 430/108.6
See application file for complete search history.

(56) References Cited

U.S. PATENT DOCUMENTS

| | | | |
|---|---|---|---|
| 5,976,752 | A | 11/1999 | Matsunaga et al. |
| 6,060,202 | A | 5/2000 | Ogawa et al. |
| 6,238,834 | B1 | 5/2001 | Tamura et al. |
| 6,426,169 | B1 | 7/2002 | Onuma et al. |
| 6,485,875 | B1 | 11/2002 | Karaki et al. |
| 6,875,549 | B2 | 4/2005 | Yamazaki et al. |
| 6,881,527 | B2 | 4/2005 | Moribe et al. |
| 7,001,703 | B2 | 2/2006 | Moribe et al. |
| 7,135,263 | B2 | 11/2006 | Kawakami et al. |
| 7,238,387 | B2 | 7/2007 | Ogawa et al. |
| 7,368,211 | B2 | 5/2008 | Hasegawa et al. |
| 7,422,832 | B2 | 9/2008 | Ogawa et al. |
| 7,470,494 | B2 | 12/2008 | Nishiyama et al. |
| 7,582,401 | B2 | 9/2009 | Ogawa et al. |
| 7,678,524 | B2 | 3/2010 | Hasegawa et al. |
| 7,704,659 | B2 | 4/2010 | Ogawa et al. |
| 7,811,734 | B2 | 10/2010 | Ogawa et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,288,069 | B2 | 10/2012 | Fujikawa et al. |
| 8,501,377 | B2 | 8/2013 | Takahashi et al. |
| 8,512,925 | B2 | 8/2013 | Moribe et al. |
| 9,046,800 | B2 | 6/2015 | Hotta et al. |
| 9,075,328 | B2 | 7/2015 | Minagawa et al. |
| 9,097,998 | B2 | 8/2015 | Yamazaki et al. |
| 9,128,400 | B2 | 9/2015 | Takahashi et al. |
| 9,158,217 | B2 | 10/2015 | Takahashi et al. |
| 9,372,420 | B2 | 6/2016 | Mizo et al. |
| 9,454,094 | B2 | 9/2016 | Tsujimoto et al. |
| 9,606,466 | B2 | 3/2017 | Takahashi et al. |
| 9,665,021 | B2 | 5/2017 | Ohtsu et al. |
| 9,665,023 | B2 | 5/2017 | Kamae et al. |
| 9,671,707 | B2 | 6/2017 | Minagawa et al. |
| 9,703,216 | B2 | 7/2017 | Tsuchida et al. |
| 9,915,885 | B2 | 3/2018 | Katsumata et al. |
| 9,969,834 | B2 | 5/2018 | Ohtsu et al. |
| 10,012,918 | B2 | 7/2018 | Ishigami et al. |
| 10,012,921 | B2 | 7/2018 | Kamae et al. |
| 10,133,201 | B2 | 11/2018 | Kamae et al. |
| 10,216,108 | B2 | 2/2019 | Iwasaki et al. |
| 10,234,777 | B2 | 3/2019 | Ohtsu et al. |
| 10,423,090 | B2 | 9/2019 | Ohtsu et al. |
| 10,451,985 | B2 | 10/2019 | Takahashi et al. |
| 2002/0055053 | A1 | 5/2002 | Kasuya et al. |
| 2004/0110076 | A1 | 6/2004 | Yamazaki et al. |
| 2011/0103836 | A1 | 5/2011 | Adachi |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2014/0137428 | A1 | 5/2014 | Takenaka et al. |
| 2015/0268576 | A1 | 9/2015 | Saito et al. |
| 2018/0275540 | A1 | 9/2018 | Matsuo et al. |
| 2019/0155182 | A1 | 5/2019 | Watanabe et al. |
| 2019/0339629 | A1 | 11/2019 | Yamashita et al. |

FOREIGN PATENT DOCUMENTS

| | | |
|---|---|---|
| EP | 2 818 932 | 12/2014 |
| EP | 2 853 945 | 4/2015 |
| EP | 3 379 334 | 9/2018 |
| JP | 2004-037786 | 2/2004 |
| JP | 2004-309910 | 11/2004 |
| JP | 2005-107365 | 4/2005 |
| JP | 2005-338750 | 12/2005 |
| JP | 2007-279239 | 10/2007 |
| JP | 2010-044113 | 2/2010 |

OTHER PUBLICATIONS

U.S. Appl. No. 16/531,306, Ryuichiro Matsuo, filed Aug. 5, 2019.
U.S. Appl. No. 16/550,418, Daisuke Tsujimoto, filed Aug. 26, 2019.
U.S. Appl. No. 16/571,427, Nobuyoshi Sugahara, filed Sep. 16, 2019.
U.S. Appl. No. 16/707,540, Toru Takahashi, filed Dec. 9, 2019.

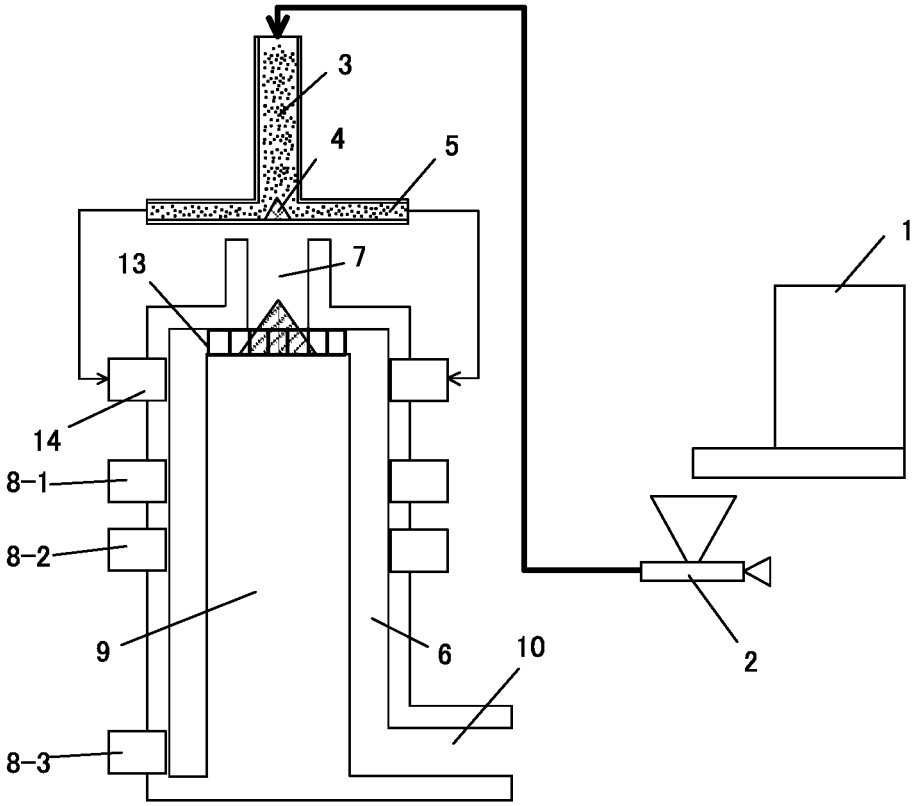
3
4
5
1
13
7
14
8-1
8-2
9
6
10
2
8-3

TONER

BACKGROUND OF THE INVENTION

Field of the Invention

The present disclosure relates to a toner used, for example, for an electrophotographic method, an electrostatic recording method, and an electrostatic printing method.

Description of the Related Art

As full color copying machines using an electrophotographic method have been widely used, higher image quality and lower energy consumption are increasingly required. In particular, due to higher processing speed and longer durability, a toner having more stable charging property and higher flowability than ever before is required. The toner contains an external additive for the charging property and the flowability. In order to improve the flowability of a toner, typically, an external additive having a small primary particle diameter is preferably used. After long-term use, the external additive having a small particle diameter is embedded in toner particles to lose the external additive function, unfortunately. When used for a long time, an external additive is removed or migrates from the toner particle surface, causing a change in the charging property or flowability.

Japanese Patent Application Laid-Open No. 2007-279239 discloses a technique of heat-treating toner particles for fixing silica as an external additive to the toner particles. There is, however, a room for improvement in balance of the flowability and the charging property.

SUMMARY OF THE INVENTION

The present inventors have found that by controlling the existence state of strontium titanate in a surface of a toner particle, charging property and flowability can be controlled even after long-term use. In the present disclosure, the present state of the strontium titanate is regulated by a "water-washed toner" that the strontium titanate particle desorbable by water washing has been removed from the toner by water washing. In other words, the present inventors have found that for a water-washed toner, the particle diameter of strontium titanate and the relation of the abundance of an Sr atom on the outermost surface and the abundance of an Sr particle from the outermost surface in the depth direction, determined by X-ray photoelectron spectrometer (ESCA), are important, and the invention has been completed.

In other words, the present disclosure relates to a toner including a toner particle containing a binder resin and a colorant and including a strontium titanate particle on a surface of the toner particle, wherein when the toner is washed by water in order to remove a strontium titanate particle desorbable by water washing to obtain a water-washed toner, (a) the water-washed toner contains the strontium titanate particle, (b) the strontium titanate particle contained in the water-washed toner has a number average particle diameter of primary particle (D1) of 10 nm or more and 150 nm or less, (c) when an X-ray photoelectron spectrometer (ESCA) is used to determine distribution of an Sr element derived from strontium titanate in the water-washed toner in a depth direction, (i) when an Sr element abundance on an outermost surface is represented by x (atomic %), x satisfies $0.00<x\leq0.80$, (ii) the distribution has at least one peak of the Sr element abundance in a region from the outermost surface to 50 nm, and (iii) when a difference between x and xp is represented by xp−x, xp−x satisfies $0.00<xp-x\leq0.95$, where xp (atomic %) is an Sr element abundance at a maximum peak in a region from the outermost surface to 50 nm in the distribution.

Further features of the present disclosure will become apparent from the following description of exemplary embodiments with reference to the attached drawing.

BRIEF DESCRIPTION OF THE DRAWINGS

FIGURE is a view of a heat spheroidization apparatus used in the present disclosure.

DESCRIPTION OF THE EMBODIMENTS

A toner of the present disclosure relates to a toner including a toner particle containing a binder resin and a colorant and including a strontium titanate particle on the surface of the toner particle, when the toner is washed by water in order to remove a strontium titanate particle desorbable to obtain a water-washed toner by water washing, (a) the water-washed toner contains the strontium titanate particle, (b) the strontium titanate particle contained in the water-washed toner has a number average particle diameter of primary particle (D1) of 10 nm or more and 150 nm or less, (c) when an X-ray photoelectron spectrometer (ESCA) is used to determine distribution of an Sr element derived from strontium titanate in the water-washed toner in the depth direction, (i) when the Sr element abundance on the outermost surface is represented by x (atomic %), x satisfies $0.00<x\leq0.80$ (ii) the distribution has at least one peak of the Sr element abundance in a region from the outermost surface to 50 nm, and (iii) when the difference between x and xp is represented by xp−x, xp−x satisfies $0.00<xp-x\leq0.95$, where xp (atomic %) is an Sr element abundance at a maximum peak in a region from the outermost surface to 50 nm in the distribution.

The toner of the present disclosure includes a strontium titanate particle on the surface of a toner particle. The strontium titanate particle on the surface of the toner particle improve charging property of the toner. An improvement of the charging property in the present disclosure means that there is no large difference in the electrification amount of a toner between a high temperature and high humidity environment (a temperature of 30° C., a relative humidity of 80%) and an ordinary temperature and low humidity environment (a temperature of 23° C., a relative humidity of 5%). The present inventors suggest the following reason why a toner including a strontium titanate particle on the toner surface has a higher charging property. The toner of the present disclosure includes the strontium titanate particle on the toner particle surface, and thus the toner is unlikely to adsorb water. This can suppress a reduction in electrification amount in a high temperature and high humidity environment and can suppress excess charging up of toner particle in a low temperature and low humidity environment.

The toner of the present disclosure is a water-washed toner but includes a strontium titanate particle. The "water-washed toner" means a toner after water washing a toner to remove a strontium titanate particle desorbable by water washing. The strontium titanate particle contained in the water-washed toner has a number average particle diameter of primary particle (D1) of 10 nm or more and 150 nm or less. In the present disclosure, the water-washed toner is considered to be in a toner state when a toner deteriorates after long-term use. When the strontium titanate particle in a water-washed toner has a primary particle diameter within the above range, satisfactory charging property is achieved even after long-term use. The strontium titanate particle preferably has a number average particle diameter of primary particle (D1) of 25 nm or more and 45 nm or less. The strontium titanate particle preferably has a cubic shape or a rectangular parallelepiped shape.

The number average particle diameter of primary particle (D1) of strontium titanate particle can be adjusted within the above range, for example, by the mixing ratio of a titanium oxide source and a metal source other than titanium when a metal titanate particle is produced by the normal pressure thermal reaction method described later, the reaction temperature when an aqueous alkali solution is added, and the reaction time.

In the toner of the present disclosure, when an X-ray photoelectron spectrometer (ESCA) is used to determine distribution of an Sr element derived from strontium titanate in the water-washed toner in the depth direction, (i) when the Sr element abundance on the outermost surface is represented by x (atomic %), x satisfies $0.00<x\leq0.80$, (ii) the distribution has at least one peak of the Sr element abundance in a region from the outermost surface to 50 nm, (iii) when the difference between x and xp is represented by xp−x, xp−x satisfies $0.00<xp-x\leq0.95$, where xp is a maximum peak value (atomic %) of the Sr element abundance in a region from the outermost surface to 50 nm.

When the Sr element abundance on the outermost surface of a water-washed toner is within the above range, the toner can maintain satisfactory charging property and flowability even when the toner deteriorates after long-term use.

In the present disclosure, the water-washed toner has at least one Sr element abundance peak in a region from the outermost surface to 50 nm. This indicates that in the water-washed toner, a larger number of Sr elements derived from strontium titanate particles are present in the toner than on the outermost surface. The water-washed toner in such a state prevents the elimination of strontium titanate particles and can maintain charging property even after long-term use.

When the difference in Sr element abundance between the maximum peak value and the value on the outermost surface is within the above range, the toner after long-term use can maintain the charging property and flowability.

The toner of the present disclosure preferably contains strontium titanate particles at 0.5% by mass or more and 10.0% by mass or less. When containing strontium titanate particles within the above range, the toner obtains higher charging property.

In the toner of the present disclosure, the fixing rate of the strontium titanate particles is preferably 55% by mass or more and 95% by mass or less. When the fixing rate is within the above range, the flowability can be maintained even when the toner deteriorates after long-term use, and harmful effects on images can be suppressed.

In the present disclosure, when the maximum peak value is represented by xp, xp satisfies preferably 0.05 atomic % or more and 0.95 atomic % or less. When xp is fallen within the above range, the toner can satisfy both the charging property and the flowability even when the toner deteriorates after long-term use.

In the present disclosure, the fixing rate of strontium titanate particles, the Sr element abundance on the outermost surface of a water-washed toner, and the maximum peak value represented by xp, can be adjusted by the amount of strontium titanate particles, external additive conditions (rotation speed, rotation time), and the temperature of heat treatment.

The surface of the strontium titanate particle is preferably hydrophobically treated. When the surface of the strontium titanate particle is hydrophobically treated, the toner is unlikely to adsorb water even under a high temperature and high humidity condition, and thus the charging property is further improved.

The surface of the strontium titanate particle is preferably hydrophobically treated with a fluorine silane coupling agent. When the surface is hydrophobically treated with a fluorine silane coupling agent, the toner is unlikely to absorb water and has a higher charging property.

The strontium titanate particle preferably has a volume resistivity of $2.0\times10^{9}$ Ω·cm or more and $2.0\times10^{13}$ Ω·cm or less. When the strontium titanate particle has a volume resistivity within the range, the electrification distribution can have a sharp curve, and the charging property is improved. In addition, charge injection by transfer bias can be suppressed in a transfer step. The volume resistivity is even more preferably $2.0\times10^{10}$ Ω·cm or more and $2.0\times10^{12}$ Ω·cm or less. The volume resistivity can be controlled by the degree of hydrophobic treatment on the surface of the strontium titanate particle.

<Method for Producing Strontium Titanate Particles>

Strontium titanate particles can be produced, for example, by a normal pressure thermal reaction method. For the reaction, a mineral acid deflocculation product of a hydrolysate of a titanium compound is preferably used as the titanium oxide source, and a water-soluble acidic metal compound is preferably used as the metal source other than titanium. A mixed liquid of the materials can be reacted at 60° C. or more while an aqueous alkali solution is added, and next the product can be treated with an acid, giving strontium titanate particles.

The normal pressure thermal reaction method will next be described.

As the titanium oxide source, a mineral acid deflocculation product of a hydrolysate of a titanium compound is used. Preferably, metatitanic acid prepared by a sulfuric acid method and having an $SO_3$ content of 1.0% by mass or less, more preferably 0.5% by mass or less, is adjusted with hydrochloric acid to have a pH of 0.8 or more and 1.5 or less, and the resulting deflocculation product is used.

As the metal source other than titanium, a nitrate or chloride of a metal can be used, for example.

As the nitrate, for example, strontium nitrate can be used. As the chloride, for example, strontium chloride can be used. The strontium titanate particles obtained here have a perovskite crystal structure, which is preferred in terms of further improving the electrification environment stability.

As the aqueous alkali solution, caustic alkalis can be used, and specifically an aqueous sodium hydroxide solution is preferred.

Examples of the factor affecting the particle diameter of the resulting metal titanate particles in the production method include pH when metatitanic acid is deflocculated with hydrochloric acid, the mixing ratio of a titanium oxide source and a metal source other than titanium, the concentration of a titanium oxide source at the initial stage of the reaction, the temperature when an aqueous alkali solution is added, the addition speed, the reaction time, and the stirring condition. In particular, when the temperature of the system is rapidly decreased to stop the reaction, for example, by addition into ice water after the addition of an aqueous alkali solution, the reaction can be forcedly stopped before saturation of crystal growth, and a wide particle size distribution is easily achieved. Alternatively, for example, by reducing the stirring speed or changing the stirring method to make the reaction system be in an inhomogeneous state, a wide particle size distribution can also be achieved.

These factors can be appropriately adjusted in order to give metal titanate particles having an intended particle diameter and particle size distribution. To prevent formation of carbonates in the reaction process, the reaction is preferably performed, for example, in a nitrogen gas atmosphere to prevent contamination of carbon dioxide gas.

For the reaction, the mixing ratio between the titanium oxide source and the metal source other than titanium is, in terms of molar ratio of $M_XO/TiO_2$ where M is a metal other than titanium and $M_XO$ is an oxide thereof, preferably 0.90 or more and 1.40 or less and more preferably 1.05 or more and 1.20 or less. X is "1" when M is an alkaline earth metal and is "2" when M is an alkali metal.

When $M_XO/TiO_2$ (molar ratio) is 1.00 or less, a reaction product not only contains a metal titanate but also is likely contain an unreacted titanium oxide. The metal source other than titanium has relatively high solubility in water, whereas the titanium oxide source has low solubility in water. Hence, when $M_XO/TiO_2$ (molar ratio) is 1.00 or less, a reaction product not only contain a metal titanate but also is likely to contain an unreacted titanium oxide.

The concentration of the titanium oxide source at the initial stage of the reaction is preferably 0.050 mol/L or more and 1.300 mol/L or less and more preferably 0.080 mol/L or more and 1.200 mol/L or less in terms of $TiO_2$.

When the concentration of the titanium oxide source is high at the initial stage of the reaction, the metal titanate particle can have a small number average particle diameter of primary particle.

When the aqueous alkali solution is added at a temperature of 100° C. or more, a pressure container such as an autoclave is required. The temperature is practically preferably 60° C. or more and 100° C. or less.

As for the addition speed of the aqueous alkali solution, a smaller addition speed results in metal titanate particle having a larger particle diameter, and a larger addition speed results in metal titanate particle having a smaller particle diameter. The addition speed of the aqueous alkali solution is preferably 0.001 equivalent/h or more and 1.2 equivalent/h or less and more preferably 0.002 equivalent/h or more and 1.1 equivalent/h or less relative to the amount of the materials. The addition speed can be appropriately adjusted depending on an intended particle diameter.

In the production method, the metal titanate particles prepared by the normal pressure thermal reaction are preferably further treated with an acid. When the mixing ratio between the titanium oxide source and the metal source other than titanium, $M_XO/TiO_2$ (molar ratio), is more than 1.00 in the normal pressure thermal reaction to produce metal titanate particles, an unreacted metal source other than titanium remaining after the completion of the reaction is likely to react with carbon dioxide gas in air to generate impurities such as a metal carbonate. When surface treatment is performed to impart hydrophobicity to the surface where impurities such as a metal carbonate are left, the impurities are likely to interfere with homogeneous application of a surface treating agent. Hence, after an aqueous alkali solution is added, acid treatment is preferably performed to remove an unreacted metal source.

In the acid treatment, hydrochloric acid is preferably used to adjust the pH to 2.5 or more and 7.0 or less and more preferably the pH to 4.5 or more and 6.0 or less.

In addition to hydrochloric acid, nitric acid, acetic acid, or the like can be used as the acid for the acid treatment. If sulfuric acid is used, a metal sulfate having low solubility in water is likely to be formed.

Examples of the surface treating agent include, but are not necessarily limited to, a disilylamine compound, a halogenated silane compound, a silicone compound, and a silane coupling agent.

The disilylamine compound is a compound having a disilylamine (Si—N—Si) moiety. Examples of the disilylamine compound include hexamethyldisilazane (HMDS), N-methyl-hexamethyldisilazane, and hexamethyl-N-propyldisilazane. Examples of the halogenated silane compound include dimethyldichlorosilane.

Examples of the silicone compound include a silicone oil and a silicone resin (varnish). Examples of the silicone oil include dimethyl silicone oil, methylphenyl silicone oil, α-methylstyrene-modified silicone oil, chlorophenyl silicone oil, and fluorine-modified silicone oil. Examples of the silicone resin (varnish) include methyl silicone varnish and phenylmethyl silicone varnish.

Examples of the silane coupling agent include a silane coupling agent having an alkyl group and an alkoxy group, a silane coupling agent having an amino group and an alkoxy group, and a fluorine-containing silane coupling agent. Specific examples of the silane coupling agent include dimethyldimethoxysilane, dimethyldiethoxysilane, diethyldimethoxysilane, diethyldiethoxysilane, trimethylmethoxysilane, trimethyldiethoxysilane, triethylmethoxysilane, triethylethoxysilane, γ-glycidoxypropyltrimethoxysilane, γ-chloropropyltrimethoxysilane, γ-aminopropyltrimethoxysilane, γ-aminopropyltriethoxysilane, γ-aminopropyldimethoxymethylsilane, γ-aminopropyldiethoxymethylsilane, 3,3,3-trifluoropropyldimethoxysilane, 3,3,3-trifluoropropyldiethoxysilane, perfluorooctylethyltriethoxysilane, and 1,1,1-trifluorohexyldiethoxysilane.

In particular, a fluorine silane coupling agent such as trifluoropropyltrimethoxysilane and perfluorooctylethyltriethoxysilane is preferably used for treatment.

The above surface treating agents may be used singly or in combination of two or more of them.

As for the preferred amount of the treatment agent, 100 parts by mass of strontium titanate particles before treatment are preferably treated with 0.5 part by mass or more and 20.0 parts by mass or less of the treatment agent.

<Binder Resin>

The toner particle in the present disclosure can contain, as the binder resin, the following polymer, for example. Examples of the polymer include homopolymers of styrene or a substituted styrene, such as polystyrene, poly-p-chlorostyrene, and polyvinyltoluene; styrene copolymers such as a styrene-p-chlorostyrene copolymer, a styrene-vinyltoluene copolymer, a styrene-vinylnaphthaline copolymer, a styrene-acrylic acid ester copolymer, and a styrene-methacrylic acid ester copolymer; a styrenic copolymer resin, a polyester resin, and a hybrid resin as a mixture of a polyester resin and a vinyl resin or a partially reacted resin thereof; and polyvinyl chloride, a phenol resin, a naturally modified phenol resin, a natural resin-modified maleic acid resin, an acrylic resin, a methacrylic resin, polyvinyl acetate, a silicone resin, polyester, polyurethane, polyamide, a furan resin, an epoxy resin, a xylene resin, polyethylene, and polypropylene. Specifically, the binder resin mainly containing polyester is preferred from the viewpoint of low temperature fixability.

The monomers used in polyester include a polyhydric alcohol (divalent, trivalent, or higher valent alcohol), and a polyvalent carboxylic acid (divalent, trivalent, or higher valent carboxylic acid), an acid anhydride thereof, and/or a lower alkyl ester thereof. Here, in order to prepare a branched polymer to express "strain curability", partial crosslinking in the molecule of an amorphous resin is effective, and thus a trivalent or higher valent polyfunctional compound is preferably used. Accordingly, the material monomers of polyester preferably include a trivalent or higher valent carboxylic acid (including an acid anhydride thereof, and a lower alkyl ester thereof) and a trivalent or higher valent alcohol.

As the polyhydric alcohol monomer used in the polyester, the following polyhydric alcohol monomers can be used.

Examples of the divalent alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenols represented by Formula (A) and derivatives thereof:

(A)

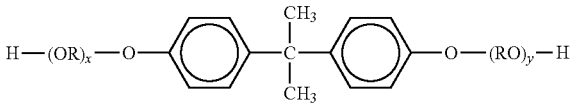

(where R is an ethylene group or a propylene group; each of x and y is an integer of 0 or more; and the average of x+y is 0 or more and 10 or less); and diols represented by Formula (B):

(B)

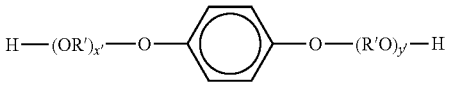

(where R' is $—CH_2CH_2—$, $—CH_3—CH(CH_3)—$, or $—CH_2—C(CH_3)_2—$; x' and y' are an integer of 0 or more; and the average of x'+y' is 0 or more and 10 or less).

Examples of the trivalent or higher valent alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Of them, glycerol, trimethylolpropane, and pentaerythritol are preferably used. These divalent alcohols and trivalent or higher valent alcohols may be used singly or in combination of two or more of them.

As the polyvalent carboxylic acid monomer used in the polyester, the following polyvalent carboxylic acid monomers can be used.

Examples of the divalent carboxylic acid component include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenylsuccinic acid, n-dodecyl succinic acid, isododecylsuccinic acid, n-octenylsuccinic acid, n-octylsuccinic acid, isooctenylsuccinic acid, isooctylsuccinic acid, acid anhydrides thereof, and lower alkyl esters thereof. Of them, maleic acid, fumaric acid, terephthalic acid, and n-dodecenylsuccinic acid are preferably used.

Examples of the trivalent or higher valent carboxylic acid, the acid anhydride thereof, and the lower alkyl ester thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof, and lower alkyl esters thereof. Specifically, 1,2,4-benzenetricarboxylic acid, i.e. trimellitic acid, or a derivative thereof is inexpensive, facilitates the control of the reaction, and thus is preferably used. These divalent carboxylic acids and trivalent or higher valent carboxylic acids may be used singly or in combination of two or more of them.

The method for producing polyester is not specifically limited, and a known method can be used. For example, the above-mentioned alcohol monomer and carboxylic acid monomer are simultaneously placed and are polymerized through esterification or transesterification and condensation, giving polyester. The polymerization temperature is not specifically limited and is preferably 180° C. or more and 290° C. or less. For the polymerization of polyester, for example, a polymerization catalyst such as a titanium catalyst, a tin catalyst, zinc acetate, antimony trioxide, and germanium dioxide can be used. In particular, the binder resin of the present disclosure is more preferably a polyester polymerized with a tin catalyst.

The polyester preferably has an acid value of 5 mg KOH/g or more and 20 mg KOH/g or less and a hydroxy value of 20 mg KOH/g or more and 70 mg KOH/g or less from the viewpoint of fog suppression because the water adsorption amount is suppressed under a high temperature and high humidity condition, and the non-electrostatic adhesion force is suppressed to a low value.

The binder resin may be a mixture of a resin having a low molecular weight and a resin having a high molecular weight. The ratio between the resin having a high molecular weight and the resin having a low molecular weight in terms of mass, low molecular weight resin/high molecular weight resin, is preferably 40/60 or more and 85/15 or less from the viewpoint of low temperature fixability and anti-hot-offset properties.

<Colorant>

The toner particle in the present disclosure may contain a colorant. As the colorant, the following colorants are exemplified.

Examples of the black colorant include carbon black; and a black mixture of a yellow colorant, a magenta colorant, and a cyan colorant. As the colorant, a pigment may be used singly, but a dye and a pigment are more preferably used in combination to improve the brightness from the viewpoint of the image quality of full color images.

Examples of the pigment for a magenta toner include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Reds 1, 2, 10, 13, 15, 23, 29, and 35.

Examples of the dye for a magenta toner include oil dyes such as C.I. Solvent Reds 1, 3, 8, 23, 24, 25, 27, 30, 49, 81, 82, 83, 84, 100, 109, and 121; C.I. Disperse Red 9; C.I. Solvent Violets 8, 13, 14, 21, and 27; and C.I. Disperse Violet 1, and basic dyes such as C.I. Basic Reds 1, 2, 9, 12, 13, 14, 15, 17, 18, 22, 23, 24, 27, 29, 32, 34, 35, 36, 37, 38, 39, and 40; and C.I. Basic Violets 1, 3, 7, 10, 14, 15, 21, 25, 26, 27, and 28.

Examples of the pigment for a cyan toner include C.I. Pigment Blues 2, 3, 15:2, 15:3, 15:4, 16, and 17; C.I. Vat Blue 6; C.I. Acid Blue 45; and copper phthalocyanine pigments having a phthalocyanine skeleton substituted with one to five phthalimide methyl groups.

Examples of the dye for a cyan toner include C.I. Solvent Blue 70.

Examples of the pigment for a yellow toner include C.I. Pigment Yellows 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellows 1, 3, and 20.

Examples of the dye for a yellow toner include C.I. Solvent Yellow 162.

These colorants may be used singly or as a mixture or used in a solid solution state. The colorant is selected in consideration of hue angle, chroma, brightness, light fastness, OHP transparency, and dispersivity in a toner.

The colorant content is preferably 0.1 parts by mass or more and 30.0 parts by mass or less relative to 100 parts by mass of the total resin components.

<Inorganic Fine Particles>

The toner in the present disclosure may contain, in addition to the above-mentioned strontium titanate particles, inorganic fine particles such as silica particles and alumina particles.

The inorganic fine particles are mixed as an external additive with toner particles. The apparatus used for mixing is not specifically limited, and a known mixer such as a Henschel Mixer, a Mechanohybrid (manufactured by NIPPON COKE & ENGINEERING Co., LTD.), a super mixer, and a Nobilta (manufactured by Hosokawa Micron Corporation) can be used.

The inorganic fine particles are preferably hydrophobized with a hydrophobizing agent such as a silane compound, a silicone oil, and a mixture thereof.

<Developer>

The toner in the present disclosure may be used as a single-component developer or may be used as a two-component developer that is a mixture with a magnetic carrier in order to suppress charge localization on the toner surface.

Examples of the magnetic carrier include commonly known carriers including iron oxides; particles of a metal such as iron, lithium, calcium, magnesium, nickel, copper, zinc, cobalt, manganese, chromium, and a rare earth, alloy particles thereof, and oxide particles thereof; a magnetic substance such as ferrite; and a magnetic substance-dispersed resin carrier containing a magnetic substance and a binder resin that holds the magnetic substance in a dispersed state (what is called a resin carrier).

When the toner is mixed with a magnetic carrier and is used as a two-component developer, the mixing ratio with the magnetic carrier in terms of the toner concentration in the two-component developer is preferably 2% by mass or more and 15% by mass or less and more preferably 4.0% by mass or more and 13.0% by mass or less.

<Method for Producing Toner>

The method for producing toner particle is not specifically limited and is preferably a pulverization method from the viewpoint of dispersion of toner materials such as a pigment.

The procedure for producing a toner by the pulverization method will next be described.

In a material mixing step, predetermined amounts of the materials constituting toner particle, such as a binder resin, a release agent, and a colorant, and an optional component including a charge control agent are weighed and mixed. Examples of the mixing apparatus include a double cone mixer, a V-type mixer, a drum mixer, a super mixer, a Henschel mixer, a Nauta mixer, and a Mechanohybrid (manufactured by NIPPON COKE & ENGINEERING Co., LTD.).

Next, the mixed materials are melted and kneaded to disperse a pigment and the like in the binder resin. In the melting and kneading step, a batch type kneader or a continuous kneader, such as a pressure kneader and a Banbury mixer, can be used. A single screw or twin screw extruder has been widely used due to advantages in continuous production. Examples of the extruder include a KTK twin-screw extruder (manufactured by Kobe Steel, Ltd.), a TEM twin-screw extruder (manufactured by Toshiba Machine), a PCM kneader (manufactured by Ikegai Machinery Co.), a twin-screw extruder (manufactured by KCK Engineering), a Co-Kneader (manufactured by Buss), and a KNEADEX (manufactured by NIPPON COKE & ENGINEERING Co., LTD.). A resin composition prepared by melting and kneading may be rolled with a two roll mill or the like and be cooled by water or the like in a cooling step.

Next, the cooled resin composition is pulverized in a pulverization step into an intended particle diameter. In the pulverization step, the composition is coarsely pulverized with a pulverizer such as a crusher, a hammer mill, and a feather mill, and then is further finely pulverized with a fine pulverizer such as a Kryptron System (manufactured by Kawasaki Heavy Industries Ltd.), a Super Rotor (manufactured by NIS SHIN ENGINEERING INC.), a Turbo Mill (manufactured by TURBO KOGYOU CO., LTD.), and an air jet type fine pulverizer.

Next, the pulverized composition is classified, as needed, with a classifier or a sieving machine, such as an Elbow-Jet of an inertial classification system (manufactured by Nittetsu Mining Co., Ltd), a Turboplex of a centrifugal classification system (manufactured by Hosokawa Micron Corporation), a TSP separator (manufactured by Hosokawa Micron Corporation), and a Faculty (manufactured by Hosokawa Micron Corporation).

Next, the toner particles are subjected to surface treatment by heat to fix an external additive to the toner particle. For example, the surface treatment apparatus shown in FIGURE can be used to perform surface treatment by hot air.

A mixture quantitatively fed by a material quantitative feeder 1 is introduced by a compressed gas adjusted with a compressed gas adjuster 2 into an inlet tube 3 provided on a vertical line of a material feeder. The mixture passed through the inlet tube is uniformly dispersed by a conical protrusion 4 provided at the center of the material feeder, then introduced into eight supplying pipes 5 that radially extend, and introduced into a treatment chamber 6 where heat treatment is performed.

The flow of the mixture fed into the treatment chamber is regulated by a regulator 9 that is provided in the treatment chamber and is for regulating the flow of the mixture. Accordingly, the mixture fed into the treatment chamber is heat-treated while whirling in the treatment chamber and then is cooled.

The hot air for heat treatment of the fed mixture is fed from a hot air feeder 7 and is introduced into the treatment chamber while whirled spirally by a whirler 13 for whirling hot air. As for the structure thereof, the whirler 13 for whirling hot air has a plurality of blades, and the number or angle of the blades enables control of the whirling of hot air. The hot air fed into the treatment chamber preferably has a temperature of 100° C. to 300° C. at an outlet of the hot air feeder 7. When the temperature at the outlet of the hot air feeder is within the above range, toner particles can undergo uniform spheroidization while the toner particles can be prevented from fusing or coalescing due to excess heating of a mixture.

The heat-treated toner particles after heat treatment are then cooled by cool air fed from cool air feeders 8-1, 8-2, and 8-3. The air fed from the cool air feeders 8-1, 8-2, and 8-3 preferably has a temperature of −20° C. to 30° C. When the cool air has a temperature within the above range, heat-treated toner particles can be efficiently cooled, and the heat-treated toner particles can be prevented from fusing or coalescing without interference with uniform spheroidization of the mixture. The cool air preferably has an absolute water content of 0.5 $g/m^3$ or more and 15.0 $g/m^3$ or less.

Next, the cooled heat-treated toner particles are collected by a collector 10 at the lower end of the treatment chamber. The collector is connected to a blower (not shown), which performs suction conveyance.

A fine particle inlet 14 is so provided that the spiral direction of the fed mixture is the same as the spiral direction of the hot air, and the collector 10 of the surface treatment apparatus is so provided on the peripheral part of the treatment chamber that the spiral direction of the whirling fine particles is maintained. The cool air feeder is so constructed as to feed a cool air from the apparatus peripheral part to the inner peripheral face of the treatment chamber in the horizontal and tangential direction. The spiral direction of the toner particles fed from the fine particle inlet, the spiral direction of the cool air fed from the cool air feeder, and the spiral direction of the hot air fed from the hot air feeder are all the same. This structure prevents a turbulent flow in the treatment chamber, strengthens the swirling flow in the apparatus, applies a strong centrifugal force to the toner particles, and further improves the dispersibility of the toner particle, resulting in production of a toner particle containing a few coalescing particles and having a uniform shape.

When the toner particle have an average circularity of 0.960 or more and 0.980 or less, the non-electrostatic adhesion force can be suppressed to a low value, and such a condition is preferred from the viewpoint of fogging properties.

Next, the surface of the heat-treated toner particles may be treated with an intended amount of an external additive. Examples of the treatment method with an external additive include a stirring and mixing method by using, as an external adding machine, a mixer such as a double cone mixer, a V-type mixer, a drum mixer, a super mixer, a Henschel mixer, a Nauta mixer, a Mechanohybrid (manufactured by NIPPON COKE & ENGINEERING Co., LTD.), and a Nobilta (manufactured by Hosokawa Micron Corporation). During the treatment, another external additive such as a fluidizing agent may be added as needed.

In the present disclosure, it is preferred that strontium titanate particles be added before the surface treatment (heat treatment), and then the heat treatment be performed to bury the strontium titanate particles in the surface of toner particles. In the present disclosure, strontium titanate particles are preferably further added after the heat treatment.

Measurement methods of various physical properties of a toner and raw materials will next be described.

<Water Washing Treatment Method>

In the present disclosure, the water washing treatment is performed as follows. In 10.3 g of ion-exchanged water, 20.7 g of sucrose (manufactured by Kishida Chemical Co., Ltd.) is dissolved to give an aqueous sucrose solution in a 30-mL glass vial (for example, VCV-30 having an outer diameter of 35 mm and a height of 70 mm, manufactured by Nichiden-Rika Glass Co., Ltd.), then 6 mL of Contaminon N (a neutral detergent for washing precision apparatuses, having a pH of 7 and containing a nonionic surfactant, an anion surfactant, and an organic builder, manufactured by Wako Pure Chemical Industries, Ltd.) as a surfactant is added, and the whole is thoroughly mixed to prepare a dispersion liquid. In the vial, 1.0 g of a toner is added, and the whole is allowed to stand until the toner is naturally settled, giving a dispersion liquid before treatment. The dispersion liquid is shaken with a shaker (YS-8D: manufactured by Yayoi Co., Ltd) at a shaking rate of 200 rpm for 5 minutes to remove inorganic fine particles from the toner particle surface. A toner still having inorganic fine particles is separated from the removed inorganic fine particles by using a centrifuge separator. The centrifugal separation was performed at 3,700 rpm for 30 minutes. The toner still having inorganic fine particles is collected by suction filtration and is dried to give a water-washed toner.

<Measurement Method of Fixing Rate>

The fixing rate is measured by the following procedure. First, the amount of strontium particles contained in a toner before the water washing treatment is quantitatively determined. This is performed by measuring the Sr element intensity in a toner with a wavelength dispersive X-ray fluorescence spectrometer, Axios advanced (manufactured by PANalytical). Next, the Sr element intensity of a toner after the water washing treatment is determined in the same manner. The fixing rate (%) can be calculated in accordance with (Sr element intensity in toner after water washing/Sr element intensity in toner before water washing)×100.

<Measurement Method of Sr Element Depth Profile by XPS>

The Sr element depth profile on the surface of a water-washed toner is determined with an XPS by the following procedure. A measurement sample is prepared as follows: about 2 g of a toner is placed in an aluminum ring exclusively for pressing and is flatted; and then the toner is pressed at 20 MPa for 60 seconds by using a tablet molding compressor, "BRE-32" (manufactured by Maekawa Testing Machine Mfg. Co., Ltd.), giving a molded pellet having a thickness of about 2 mm and a diameter of about 20 mm.

The molded pellet is attached to a 20-mmφ platen of an XPS with a carbon tape or the like.

Used apparatus: PHI5000 VersaProbe II manufactured by Ulvac-Phi, Inc

Irradiation ray: Al-Kα ray

Output power: 100μ, 25 W, 15 kV

Photoelectron uptake angle: 45°

Pass Energy: 58.70 eV
Stepsize: 0.125 eV
XPS peaks: $C_{2p}$, $O_{2p}$, $Si_{2p}$, $Ti_{2p}$, $Sr_{3d}$
Measurement range: 300 μm×200 μm
GUN type: GCIB
Time: 15 min
Interval: 1 min
Sputter Setting: 20 kV In the above conditions, measurement was performed.

<Volume Resistivity Measurement>

The volume resistivity of strontium titanate particles is determined by the following procedure. As the apparatus, a 6517 Electrometer/high resistance system manufactured by Keithley Instruments is used. Electrodes having a diameter of 25 mm are connected, then strontium titanate particles are so placed between the electrodes as to have a thickness of about 0.5 mm, and the distance between the electrodes is measured while a load of about 2.0 N is applied.

When a voltage of 1,000 V is applied to the strontium titanate particles for 1 minute, the resistance value is measured, and the volume resistivity is calculated in accordance with the following equation.

$$\text{Volume resistivity}(\Omega\cdot\text{cm})=R\times L$$

R: resistance value (Ω)
L: distance between electrodes (cm)

<Measurement of Primary Particle Diameters of Strontium Titanate Particles and Inorganic Fine Particles on Toner Particle Surface>

The primary particle diameters of strontium titanate particles and inorganic fine particles on the toner particle surface were determined by observation of the inorganic fine particles on the toner particle surface by using a scanning electron microscope (SEM) "S-4700" (manufactured by Hitachi, Ltd.).

The observation magnification is appropriately controlled depending on the size of fine particles. In a visual field at a magnifying power of up to 200,000, the major axis lengths of 100 primary particles are measured, and the average is calculated as the number average particle diameter.

On the toner particle surface, strontium titanate particles and silica particles can be differentiated as follows based on shape. Silica particles have an indefinite shape or a spherical shape, whereas strontium titanate particles have a rectangular parallelepiped shape or a cubic shape.

EXAMPLES

The present disclosure will next be described in further detail with reference to examples and comparative examples, but the aspects of the present disclosure are not limited to them. The amounts (parts) in examples and comparative examples are in terms of mass unless specifically noted.

Production Example of Strontium Titanate Particles 1

Metatitanic acid prepared by the sulfuric acid method was subjected to an iron removal and bleaching treatment, then a 3 mol/L aqueous sodium hydroxide solution was added to adjust the pH to 9.0 to perform desulfurization treatment. Next, a 5 mol/L hydrochloric acid was added to neutralize the mixture to have a pH of 5.6, and the mixture was filtered and washed with water. To the washed cake, water was added to give a 1.90 mol/L slurry in terms of $TiO_2$, then hydrochloric acid was added to adjust the pH to 1.4, and deflocculation treatment was performed.

After the desulfurization and deflocculation, 1.90 mol of the metatitanic acid in terms of $TiO_2$ was taken and was placed in a 3-L reaction container. To the deflocculated metatitanic acid slurry, 2.185 mol of an aqueous strontium chloride solution was so added as to give an $SrO/TiO_2$ (molar ratio) of 1.15, and then the $TiO_2$ concentration was adjusted to 1.039 mol/L.

Next, the mixture was warmed to 90° C. under stirring and mixing, then 440 mL of 10 mol/L aqueous sodium hydroxide solution was added over 40 minutes, and the mixture was further stirred at 95° C. for 45 minutes. The reaction mixture was then poured in ice water to be quenched, and the reaction was stopped.

The reaction slurry was heated to 70° C., then a 12 mol/L hydrochloric acid was added until the pH reached 5.0, and the mixture was further stirred for 1 hour. The resulting precipitate was subjected to decantation.

The slurry containing the resulting precipitate was adjusted to 40° C., then hydrochloric acid was added to adjust the pH to 2.5, and 4.6% by mass of i-butyltrimethoxysilane and 4.6% by mass of trifluoropropyltrimethoxysilane were added relative to the solid content. The mixture was stirred for 10 hours. A 5 mol/L aqueous sodium hydroxide solution was added to adjust the pH to 6.5, and then the mixture was further stirred for 1 hour. The resulting mixture was filtered and washed, and the obtained cake was dried in the atmosphere at 120° C. for 8 hours. Next, pulverization treatment was performed to give strontium titanate particles 1. Physical properties of the obtained strontium titanate particles are shown in Table 1.

Strontium Titanate Particles 2 to 18

The reaction conditions or hydrophobic treatment conditions in the production example of strontium titanate particles 1 were changed, giving strontium titanates 2 to 18 shown in Table 1.

TABLE 1

| Strontium titanate particles | Number average particle diameter (nm) | Hydrophobic treatment | Silane coupling agent Type | | Treatment amount wt % | Volume resistivity (Ω · cm) |
|---|---|---|---|---|---|---|
| 1 | 35 | treated | Trifluoropropyltrimethoxysilane | Fluorine type | 4.5 | $2\times10^{10}$ |
| | | | i-Butyltrimethoxysilane | Non-fluorine type | 4.5 | |
| 2 | 35 | treated | Perfluorooctylethyltriethoxysilane | Fluorine type | 4.5 | $2\times10^{10}$ |
| | | | i-Butyltrimethoxysilane | Non-fluorine type | 4.5 | |
| 3 | 35 | treated | Trimethoxyfluorosilane | Fluorine type | 4.5 | $2\times10^{10}$ |
| | | | i-Butyltrimethoxysilane | Non-fluorine type | 4.5 | |

TABLE 1-continued

| Strontium titanate particles | Number average particle diameter (nm) | Hydrophobic treatment | Silane coupling agent Type | | Treatment amount wt % | Volume resistivity (Ω · cm) |
|---|---|---|---|---|---|---|
| 4 | 35 | treated | Trimethoxyfluorosilane | Fluorine type | 4.5 | $2 \times 10^{9}$ |
| | | | i-Butyltrimethoxysilane | Non-fluorine type | 4.5 | |
| 5 | 35 | treated | Trimethoxyfluorosilane | Fluorine type | 4.5 | $2 \times 10^{13}$ |
| | | | i-Butyltrimethoxysilane | Non-fluorine type | 4.5 | |
| 6 | 35 | treated | Trimethoxyfluorosilane | Fluorine type | 4.5 | $2 \times 10^{8}$ |
| | | | i-Butyltrimethoxysilane | Non-fluorine type | 4.5 | |
| 7 | 35 | treated | Trimethoxyfluorosilane | Fluorine type | 4.5 | $2 \times 10^{14}$ |
| | | | i-Butyltrimethoxysilane | Non-fluorine type | 4.5 | |
| 8 | 35 | treated | i-Butyltrimethoxysilane | Non-fluorine type | 8 | $2 \times 10^{14}$ |
| 9 | 35 | treated | n-Octyltriethoxysilane | Non-fluorine type | 8 | $2 \times 10^{14}$ |
| 10 | 35 | not treated | — | — | 0 | $2 \times 10^{14}$ |
| 11 | 25 | not treated | — | — | 0 | $2 \times 10^{14}$ |
| 12 | 45 | not treated | — | — | 0 | $2 \times 10^{14}$ |
| 13 | 20 | not treated | — | — | 0 | $2 \times 10^{14}$ |
| 14 | 50 | not treated | — | — | 0 | $2 \times 10^{14}$ |
| 15 | 10 | not treated | — | — | 0 | $2 \times 10^{14}$ |
| 16 | 150 | not treated | — | — | 0 | $2 \times 10^{14}$ |
| 17 | 5 | not treated | — | — | 0 | $2 \times 10^{14}$ |
| 18 | 200 | not treated | — | — | 0 | $2 \times 10^{14}$ |

Synthesis of Binder Resin

Polyoxypropylene(2.2)-2,2-bis(4-hydroxyphenyl)propane: 80.0 mol % relative to the total number of moles of polyhydric alcohols Polyoxyethylene(2.2)-2,2-bis(4-hydroxyphenyl)propane: 20.0 mol % relative to the total number of moles of polyhydric alcohols Terephthalic acid: 80.0 mol % relative to the total number of moles of polyvalent carboxylic acids Trimellitic anhydride: 20.0 mol % relative to the total number of moles of polyvalent carboxylic acids In a reaction vessel with a condenser, a stirrer, a nitrogen inlet tube, and a thermocouple, the above materials were placed. Relative to 100 parts of the total monomers, 1.5 parts of tin 2-ethylhexanoate (esterification catalyst) was added as a catalyst. Next, the air in the flask was purged with nitrogen gas, then the mixture was gradually heated under stirring and was reacted for 2.5 hours under stirring at a temperature of 200° C.

The pressure in the reaction vessel was reduced to 8.3 kPa, and the conditions were maintained for 1 hour. The mixture was then cooled to 180° C., and the reaction was continued. After confirmation that the softening point determined in accordance with ASTM D36-86 reached 110° C., the mixture was cooled to stop the reaction, giving polyester A. The polyester A had a peak molecular weight of 9,500, a weight average molecular weight of 20,000, and a glass transition temperature of 60° C.

Production Example of Toner 1

Polyester A: 100.0 parts

Aluminum 3,5-di-t-butylsalicylate compound: 0.1 parts

Fischer-Tropsch wax (a maximum endothermic peak temperature of 90° C.): 5.0 parts C.I. Pigment Blue 15:3:5.0 parts The above materials were mixed by using a Henschel Mixer (FM-75, manufactured by Mitsui Mining Co., Ltd.) at a rotation speed of 1,500 rpm for a rotation time of 5 min, and then the mixture was kneaded by using a twin-screw kneader set at a temperature of 130° C. (PCM-30, manufactured by Ikegai Machinery Co.). The kneaded product was cooled and was coarsely pulverized by using a hammer mill into 1 mm or less, giving a coarsely pulverized product. The obtained coarsely pulverized product was finely pulverized by using a mechanical pulverizer (T-250, manufactured by TURBO KOGYOU CO., LTD.). A Faculty (F-300, manufactured by Hosokawa Micron Corporation) was further used to perform classification, giving toner mother particles 1. As the running conditions, the classification rotor was set at a rotation speed of 11,000 rpm, and the dispersion rotor was set at a rotation speed of 7,200 rpm.

Toner mother particles 1: 100 parts

Strontium titanate particles 1: 0.5 parts

The materials shown in the above formula were mixed by using a Henschel Mixer (FM-10C, manufactured by NIPPON COKE & ENGINEERING Co., LTD.) at a rotation speed of 2,000 rpm for a rotation time of 2 minutes, and then the mixture was subjected to heat treatment by using the surface treatment apparatus shown in FIGURE, giving heat-treated toner particles. As the running conditions, the feeding amount was set at 5 kg/hr, the hot air temperature was set at 160° C., the hot air flow rate was set at 6 $m^3$/min, the cool air temperature was set at −5° C., the cool air flow rate was set at 4 $m^3$/min, the blower air amount was set at 20 $m^3$/min, and the injection air flow rate was set at 1 m3/min.

Heat-treated toner particles: 100 parts

Silica fine particles (a number-based median diameter (D50) of 5 nm): 2.5 parts

Strontium titanate particles 1: 0.5 parts

The materials shown in the above formula were mixed by using a Henschel Mixer (FM-10C, manufactured by NIPPON COKE & ENGINEERING Co., LTD.) at a rotation speed of 67 $s^{-1}$ (4,000 rpm) for a rotation time of 2 minutes, and the mixture was passed through an ultrasonic vibration sieve having a mesh size of 54 μm, giving toner 1.

Production Examples of Toners 2 to 33 and 36

The same procedure as in the production example of toner 1 was performed except that the type of strontium titanate particles, the amount (parts), whether heat treatment is performed, and heat treatment conditions were changed, giving toners 2 to 33 and 36 shown in Table 2.

Production Examples of Toners 34 and 35

The toner mother particles 1 were prepared in the same manner as in the production example of toner 1, then materials in accordance with the following formulation were mixed by using a Nobilta (NOB130 (manufactured by Hosokawa Micron Corporation)) at a rotation speed of 4,500 rpm for a rotation time of 5 minutes, and the mixture was passed through an ultrasonic vibration sieve having a mesh size of 54 μm, giving toner 34.

Toner mother particles: 100 parts

Silica fine particles (a number-based median diameter (D50) of 5 nm): 2.5 parts

Strontium titanate particles 1: 13.0 parts

The same procedure as in the production example of toner 34 was performed except that the amount of strontium titanate particles 1 was changed in accordance with Table 2, giving toner 35.

TABLE 2

| | Strontium titanate particles | | | Water-washed toner particles | | | | | Toner | |
|---|---|---|---|---|---|---|---|---|---|---|
| | | | | | | Peak in region from outermost surface to 50 nm | | | | |
| Toner | Type | Amount before heat treatment (to 100 parts of toner mother particles) Parts | Amount after heat treatment (to 100 parts of heat-treated toner particles) Parts | Number average particle diameter of primary particle of strontium titanate particles nm | Sr element abundance on outermost surface, x atomic % | Presence or absence | Sr element abundance at maximum peak, xp atomic % | Difference (xp − x) atomic % | Fixing rate % | Content of strontium titanate particles mass % |
| Toner 1 | 1 | 0.5 | 0.5 | 35 | 0.07 | Presence | 0.30 | 0.23 | 75 | 0.99 |
| Toner 2 | 2 | 0.5 | 0.5 | 35 | 0.07 | Presence | 0.30 | 0.23 | 75 | 0.99 |
| Toner 3 | 3 | 0.5 | 0.5 | 35 | 0.07 | Presence | 0.30 | 0.23 | 75 | 0.99 |
| Toner 4 | 4 | 0.5 | 0.5 | 35 | 0.07 | Presence | 0.30 | 0.23 | 75 | 0.99 |
| Toner 5 | 5 | 0.5 | 0.5 | 35 | 0.07 | Presence | 0.30 | 0.23 | 75 | 0.99 |
| Toner 6 | 6 | 0.5 | 0.5 | 35 | 0.07 | Presence | 0.30 | 0.23 | 75 | 0.99 |
| Toner 7 | 7 | 0.5 | 0.5 | 35 | 0.07 | Presence | 0.30 | 0.23 | 75 | 0.99 |
| Toner 8 | 8 | 0.5 | 0.5 | 35 | 0.07 | Presence | 0.30 | 0.23 | 75 | 0.99 |
| Toner 9 | 9 | 0.5 | 0.5 | 35 | 0.07 | Presence | 0.30 | 0.23 | 75 | 0.99 |
| Toner 10 | 10 | 0.5 | 0.5 | 35 | 0.07 | Presence | 0.30 | 0.23 | 75 | 0.99 |
| Toner 11 | 11 | 0.5 | 0.5 | 25 | 0.07 | Presence | 0.30 | 0.23 | 75 | 0.99 |
| Toner 12 | 12 | 0.5 | 0.5 | 45 | 0.07 | Presence | 0.30 | 0.23 | 75 | 0.99 |
| Toner 13 | 13 | 0.5 | 0.5 | 20 | 0.07 | Presence | 0.30 | 0.23 | 75 | 0.99 |
| Toner 14 | 14 | 0.5 | 0.5 | 50 | 0.07 | Presence | 0.45 | 0.38 | 75 | 0.99 |
| Toner 15 | 14 | 0.5 | 0.5 | 50 | 0.72 | Presence | 0.95 | 0.23 | 90 | 0.99 |
| Toner 16 | 14 | 0.3 | 0.3 | 50 | 0.02 | Presence | 0.05 | 0.03 | 60 | 0.60 |
| Toner 17 | 14 | 0.5 | 0.5 | 50 | 0.72 | Presence | 0.98 | 0.26 | 90 | 0.99 |
| Toner 18 | 14 | 0.3 | 0.3 | 50 | 0.02 | Presence | 0.04 | 0.02 | 56 | 0.60 |
| Toner 19 | 14 | 0.3 | 0.3 | 50 | 0.02 | Presence | 0.04 | 0.02 | 55 | 0.60 |
| Toner 20 | 14 | 1.0 | 1.0 | 50 | 0.75 | Presence | 0.98 | 0.23 | 95 | 1.96 |
| Toner 21 | 14 | 1.0 | 1.0 | 50 | 0.75 | Presence | 0.98 | 0.23 | 97 | 1.96 |
| Toner 22 | 14 | 0.3 | 0.3 | 50 | 0.02 | Presence | 0.04 | 0.02 | 50 | 0.60 |
| Toner 23 | 14 | 0.3 | 0.2 | 50 | 0.02 | Presence | 0.04 | 0.02 | 50 | 0.50 |
| Toner 24 | 14 | 5.0 | 5.0 | 50 | 0.03 | Presence | 0.04 | 0.01 | 5 | 9.09 |
| Toner 25 | 14 | 5.0 | 6.5 | 50 | 0.03 | Presence | 0.04 | 0.01 | 10 | 10.30 |
| Toner 26 | 14 | 0.2 | 0.2 | 50 | 0.02 | Presence | 0.03 | 0.01 | 30 | 0.40 |
| Toner 27 | 14 | 5.0 | 7.0 | 50 | 0.03 | Presence | 0.98 | 0.95 | 50 | 10.71 |
| Toner 28 | 14 | 0.2 | 0.2 | 50 | 0.03 | Presence | 0.04 | 0.01 | 30 | 0.40 |
| Toner 29 | 15 | 0.2 | 0.2 | 10 | 0.03 | Presence | 0.04 | 0.01 | 30 | 0.40 |
| Toner 30 | 16 | 0.2 | 0.2 | 150 | 0.03 | Presence | 0.04 | 0.01 | 30 | 0.40 |
| Toner 31 | 16 | 5.0 | 7.0 | 50 | 0.01 | Presence | 0.98 | 0.97 | 20 | 10.71 |
| Toner 32 | 16 | Without heat treatment | 0.2 | 50 | 0.01 | Absence | Absence | — | 8 | 0.20 |
| Toner 33 | 16 | Without heat treatment | 0.1 | 50 | 0.00 | Absence | Absence | — | 5 | 0.10 |
| Toner 34 | 16 | Without heat treatment | 13.0 | 50 | 0.85 | Absence | Absence | — | 98 | 11.50 |
| Toner 35 | 17 | Without heat treatment | 0.1 | 5 | 0.90 | Absence | Absence | — | 99 | 0.10 |
| Toner 36 | 18 | Without heat treatment | 0.1 | 200 | 0.00 | Absence | Absence | — | 5 | 0.10 |

Production Example of Magnetic Core Particles 1

Step 1 (Weighing and Mixing Step):

$Fe_2O_3$: 62.7 parts $MnCO_3$: 29.5 parts $Mg(OH)_2$: 6.8 parts $SrCO_3$: 1.0 part The above materials were so weighed as to give the above composition ratio as ferrite materials. The mixture was then pulverized and mixed for 5 hours with a dry vibrating mill using stainless steel beads having a diameter of ⅛ inches.

Step 2 (Pre-Burning Step):

The resulting pulverized product was processed with a roller compactor into about 1-mm cubic pellets. The pellets were passed through a vibration sieve having a mesh size of 3 mm to remove coarse powder, then were passed through a vibration sieve having a mesh size of 0.5 mm to remove fine powder, and were burned in a burner type baking furnace in a nitrogen atmosphere (an oxygen concentration of 0.01% by volume) at a temperature of 1,000° C. for 4 hours, giving calcined ferrite. The resulting calcined ferrite had the following composition.

$$(MnO)_a(MgO)_b(SrO)_c(Fe_2O_3)_d$$

a=0.257, b=0.117, c=0.007, d=0.393

Step 3 (Pulverization Step):

The resulting calcined ferrite was pulverized with a crusher into about 0.3 mm, then 30 parts of water was added to 100 parts of the calcined ferrite, and the whole was pulverized for 1 hour with a wet ball mill using zirconia beads having a diameter of ⅛ inches. The resulting slurry was pulverized for 4 hours with a wet ball mill using alumina beads having a diameter of 1/16 inches, giving a ferrite slurry (finely pulverized calcined ferrite).

Step 4 (Granulation Step):

To the ferrite slurry, 1.0 part of ammonium polycarboxylate as a dispersant and 2.0 parts of polyvinyl alcohol as a binder were added relative to 100 parts of calcined ferrite, and the mixture was granulated into spherical particles by using a spray dryer (manufactured by Ohkawara Kakohki Co., Ltd.). The particle diameter of the obtained particles was adjusted, and the particles were heated by using a rotary kiln at 650° C. for 2 hours to remove organic components such as the dispersant and the binder.

Step 5 (Burning Step):

In order to control the burning atmosphere, the temperature in an electric furnace was increased in a nitrogen atmosphere (an oxygen concentration of 1.00% by volume) from room temperature to a temperature of 1,300° C. over 2 hours, and then the burning was performed at a temperature of 1,150° C. for 4 hours. The temperature was next decreased to a temperature of 60° C. over 4 hours, then the nitrogen atmosphere was returned to the atmosphere, and the product was taken out at a temperature of 40° C. or less.

Step 6 (Screening Step):

Aggregating particles were cracked, then low magnetic particles were removed by magnetic separation, and coarse particles were removed by sieving through a sieve having a mesh size of 250 μm, giving magnetic core particles 1 having a 50% particle diameter (D50) of 37.0 μm based on volume distribution.

Preparation of Coated Resin 1

Cyclohexyl methacrylate: 26.8% by mass

Methyl methacrylate: 0.2% by mass

Methyl methacrylate macromonomer: 8.4% by mass (a macromonomer having a methacryloyl group at an end and having a weight average molecular weight of 5,000)

Toluene: 31.3% by mass

Methyl ethyl ketone: 31.3% by mass

Azobisisobutyronitrile: 2.0% by mass

Of the above materials, cyclohexyl methacrylate, methyl methacrylate, methyl methacrylate macromonomer, toluene, and methyl ethyl ketone were placed in a four-necked separable flask equipped with a reflux condenser, a thermometer, a nitrogen inlet tube, and a stirrer, and nitrogen gas was introduced to sufficiently make a nitrogen atmosphere. Next, the mixture was heated to 80° C., then azobisisobutyronitrile was added, and the materials were polymerized under reflux for 5 hours. To the resulting reaction product, hexane was poured to precipitate a copolymer, and the precipitate was filtered and was dried under vacuum, giving coated resin 1.

Next, 30 parts of coated resin 1 was dissolved in 40 parts of toluene and 30 parts of methyl ethyl ketone, giving polymer solution 1 (a solid content of 30% by mass).

Preparation of Coated Resin Solution 1

Polymer solution 1 (a resin solid concentration of 30%): 33.3% by mass

Toluene: 66.4% by mass

Carbon black, Regal 330 (manufactured by Cabot): 0.3% by mass (a primary particle diameter of 25 nm, a nitrogen adsorption specific surface area of 94 $m^2/g$, a DBP oil absorption amount of 75 mL/100 g)

The above materials were dispersed with zirconia beads having a diameter of 0.5 mm in a paint shaker for 1 hour. The resulting dispersion liquid was filtered through a 5.0-μm membrane-filter, giving coated resin solution 1.

Production Example of Magnetic Carrier 1

(Resin Coating Step):

In a vacuum degassing kneader maintained at ordinary temperature, magnetic core particles 1 and coated resin solution 1 were placed (the amount of the coated resin solution was 2.5 parts in terms of resin component relative to 100 parts of magnetic core particles 1). After the placement, the mixture was stirred at a rotation speed of 30 rpm for 15 minutes. After a certain amount or more (80% by mass) of the solvent volatilized, the mixture was heated to 80° C. while mixed under a reduced pressure, then toluene was removed by evaporation over 2 hours, and the product was cooled. From the obtained magnetic carrier, low magnetic particles were removed by magnetic separation. The particles were passed through a sieve having an opening of 70 μm and were classified by an air classifier, giving magnetic carrier 1 having a 50% particle diameter (D50) of 38.2 μm based on volume distribution.

Production Example of Two-Component Developer 1

In a V-type mixer (V-20, manufactured by Seishin Enterprise), 92.0 parts of magnetic carrier 1 and 8.0 parts of toner 1 were mixed, giving two-component developer 1.

Production Examples of Two-Component Developers 2 to 36

The same procedure as in the production example of two-component developer 1 was performed except that toners 2 to 36 in Table 2 were used, giving two-component developers 2 to 36.

Example 1

A full color copying machine, imagePRESS C800 (copying speed: 80 pieces/min) manufactured by Canon or a modified machine thereof was used, and two-component developer 1 was placed in a developing device of a cyan station. The following evaluations were then performed. Evaluation results are shown in Table 3.

<Evaluation of Charging Property>

By suction-collecting the toner on an electrostatic latent image bearing member by using a metal cylindrical tube and a cylindrical filter, the frictional electrification amount of the toner and the toner deposition amount were calculated.

Specifically, the toner frictional electrification amount and the toner deposition amount on an electrostatic latent image bearing member were determined by a Faraday-cage.

The Faraday-cage is a coaxial double cylinder, and the inner cylinder is insulated from the outer cylinder. When a charged body having a charge amount of Q is placed in the inner cylinder, the double cylinder becomes like a metal cylinder having a charge amount of Q due to electrostatic induction. The induced charge amount was measured by an electrometer (Keithley 6517A manufactured by Keithley), and the charge amount Q (mC) was divided by the toner mass M (kg) in the inner cylinder to give a frictional electrification amount (Q/M) of the toner.

In addition, the sucked area S was measured, and the toner mass M was divided by the area S ($cm^2$) to give a toner deposition amount per unit area.

Before a toner layer formed on an electrostatic latent image bearing member was transferred onto an intermediate transfer unit, the rotation of the electrostatic latent image bearing member was stopped, and the toner image on the electrostatic latent image bearing member was directly air-sucked to determine the toner amount.

Toner deposition amount ($mg/cm^2$)=M/S

Toner frictional electrification amount (mC/kg)=Q/M

The image forming apparatus was so adjusted that the toner deposition amount on the electrostatic latent image bearing member under a high temperature and high humidity condition (32.5° C., 80% RH) was 0.35 $mg/cm^2$, and the toner was suction-collected by the metal cylindrical tube and the cylindrical filter. In the operation, the charge amount Q stored in a condenser through the metal cylindrical tube and the collected toner mass M were measured, and the charge amount per unit mass Q/M (mC/kg) was calculated as the charge amount per unit mass Q/M (mC/kg) on the electrostatic latent image bearing member (initial evaluation).

After the above evaluation (initial evaluation), the developing device was taken out of the apparatus and was allowed to stand under a high temperature and high humidity condition (30° C., 80% RH) for 72 hours. The developing device was installed in the apparatus again, and the charge amount per unit mass Q/M on the electrostatic latent image bearing member was measured at the same direct voltage $V_{DC}$ as in the initial evaluation (evaluation after storage).

The charge amount per unit mass Q/M on the electrostatic latent image bearing member in the above initial evaluation was regarded as 100%, and the retention rate of the charge amount per unit mass Q/M on the electrostatic latent image bearing member after storage for 72 hours (evaluation after storage) (evaluation after storage/initial evaluation×100) was calculated. The result was evaluated on the basis of the following criteria.

(Criteria)

A: the retention rate is not less than 80%: very good

B: the retention rate is not less than 70% and less than 80%: good

C: the retention rate is not less than 60% and less than 70%: acceptable level in the present disclosure D: the retention rate is less than 60%: unacceptable level in the present disclosure <Image Density Evaluation>

A modified apparatus of the above image forming apparatus was used. The modification was that the mechanism of discharging a magnetic carrier excess in a developing device was removed from the developing device.

The apparatus was so adjusted that the toner deposition amount in an FFh image (solid image) on paper was 0.45 $mg/cm^2$. FFh is a value representing 256 gradations in hexadecimal number: 00h is the first gradation in 256 gradations (white background part), and FFh is the 256th gradation in 256 gradations (solid color part).

In the evaluation, output test of 10,000 images was performed at an image rate of 1%. The test environment was a high temperature and high humidity (HH) environment (a temperature of 30° C., a relative humidity of 80%).

During continuous feeding of 10,000 pieces of paper, paper feeding was performed in the same developing conditions and transfer conditions as for the first paper (without calibration). The evaluation paper used was plain copy paper GF-0081 (A4, a basis weight of 81.4 $g/m^2$, purchased from Canon Marketing Japan).

Image evaluation items and criteria for the initial state (the first image) and for the continuous feeding of 10,000 pieces of paper are shown below.

An X-Rite color reflection densitometer (500 series: manufactured by X-Rite) was used to measure the image density of each FFh image part (solid color part) at the initial state (the first image) and after long-term use (the 10,000th image), and the absolute value of the difference between the image densities was ranked on the basis of the following criteria.

A: less than 0.05 (excellent)

B: not less than 0.05 and less than 0.10 (good)

C: not less than 0.10 and less than 0.15 (effect is achieved)

D: not less than 0.15 (no effect is achieved)

Evaluation of Environmental Stability

The change rates of image density in the HH environment (a temperature of 30° C., a relative humidity of 80%) and in an NL environment (a temperature of 23° C., a relative humidity of 5%) relative to the image density in the NN environment (a temperature of 23° C., a relative humidity of 60%) were used for the evaluation of the environmental stability.

After long-term use (the 10,000th image), the image density in the NN environment was regarded as DNNf, the image density in the HH environment was regarded as DHHf, and the image density in the NL environment was regarded as DNLf. An image density environmental change rate after long-term use Vf was calculated in accordance with the following equation.

$$Vf(\%)=\{(DHHf-DNLf)/DNNf\}\times 100$$

The Vf value was ranked on the basis of the following criteria.

A: less than 35% (excellent)

B: not less than 35% and less than 45% (good)

C: not less than 45% and less than 55% (effect is achieved)

D: not less than 55% (no effect is achieved)

Examples 2 to 30, Comparative Examples 1 to 6

Developers 2 to 36 were used to perform evaluations in the same manner as in Example 1. Evaluation results are shown in Table 3.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-247559, filed Dec. 28, 2018, and Japanese Patent Application No. 2018-159788, filed Aug. 28, 2018, which are hereby incorporated by reference herein in their entirety.

What is claimed is:

1. A toner, comprising:

a toner particle containing a binder resin and a colorant; and a strontium titanate particle on a surface of the toner particle, wherein when the toner is washed by water in order to remove a strontium titanate particle desorbable to obtain a water-washed toner, the water-washed toner contains the

TABLE 3

| Example/ Comparative Example | Two-component developer | Charging property evaluation: Retention rate | Charging property evaluation: Evaluation | Image density evaluation after long-term use: Image density difference | Image density evaluation after long-term use: Evaluation | Environmental stability evaluation: Image density environmental change rate | Environmental stability evaluation: Evaluation |
|---|---|---|---|---|---|---|---|
| Example 1 | Developer 1 | 92 | A | 0.02 | A | 20 | A |
| Example 2 | Developer 2 | 90 | A | 0.02 | A | 21 | A |
| Example 3 | Developer 3 | 88 | A | 0.03 | A | 23 | A |
| Example 4 | Developer 4 | 85 | A | 0.03 | A | 26 | A |
| Example 5 | Developer 5 | 84 | A | 0.03 | A | 28 | A |
| Example 6 | Developer 6 | 81 | A | 0.04 | A | 30 | A |
| Example 7 | Developer 7 | 80 | A | 0.04 | A | 31 | A |
| Example 8 | Developer 8 | 79 | B | 0.04 | A | 32 | A |
| Example 9 | Developer 9 | 78 | B | 0.04 | A | 31 | A |
| Example 10 | Developer 10 | 77 | B | 0.05 | B | 33 | A |
| Example 11 | Developer 11 | 76 | B | 0.06 | B | 34 | A |
| Example 12 | Developer 12 | 75 | B | 0.06 | B | 34 | A |
| Example 13 | Developer 13 | 73 | B | 0.07 | B | 35 | B |
| Example 14 | Developer 14 | 72 | B | 0.07 | B | 36 | B |
| Example 15 | Developer 15 | 71 | B | 0.07 | B | 37 | B |
| Example 16 | Developer 16 | 70 | B | 0.07 | B | 37 | B |
| Example 17 | Developer 17 | 69 | C | 0.08 | B | 38 | B |
| Example 18 | Developer 18 | 68 | C | 0.08 | B | 39 | B |
| Example 19 | Developer 19 | 67 | C | 0.09 | B | 40 | B |
| Example 20 | Developer 20 | 66 | C | 0.09 | B | 41 | B |
| Example 21 | Developer 21 | 65 | C | 0.10 | C | 42 | B |
| Example 22 | Developer 22 | 65 | C | 0.11 | C | 42 | B |
| Example 23 | Developer 23 | 64 | C | 0.11 | C | 43 | B |
| Example 24 | Developer 24 | 64 | C | 0.11 | C | 44 | B |
| Example 25 | Developer 25 | 63 | C | 0.12 | C | 45 | C |
| Example 26 | Developer 26 | 63 | C | 0.12 | C | 46 | C |
| Example 27 | Developer 27 | 63 | C | 0.12 | C | 47 | C |
| Example 28 | Developer 28 | 62 | C | 0.13 | C | 49 | C |
| Example 29 | Developer 29 | 61 | C | 0.13 | C | 51 | C |
| Example 30 | Developer 30 | 60 | C | 0.14 | C | 53 | C |
| Comparative Example 1 | Developer 31 | 58 | D | 0.15 | D | 55 | D |
| Comparative Example 2 | Developer 32 | 58 | D | 0.15 | D | 57 | D |
| Comparative Example 3 | Developer 33 | 55 | D | 0.16 | D | 58 | D |
| Comparative Example 4 | Developer 34 | 54 | D | 0.17 | D | 60 | D |
| Comparative Example 5 | Developer 35 | 52 | D | 0.18 | D | 64 | D |
| Comparative Example 6 | Developer 36 | 50 | D | 0.18 | D | 65 | D |

strontium titanate particle having a number average particle diameter of primary particle of 10 to 150 nm, and when a distribution of an Sr element derived from strontium titanate in the water-washed toner in a depth direction is determined, $0.00<x\leq0.80$ when x (atomic %) is an Sr element abundance on an outermost surface, the distribution has at least one peak of the Sr element abundance in a region from the outermost surface to 50 nm, and $0.00<xp-x\leq0.95$ when xp (atomic %) is an Sr element abundance at a maximum peak in the region from the outermost surface to 50 nm in the distribution.

2. The toner according to claim 1, wherein the toner contains the strontium titanate particle at 0.5 to 10.0% by mass.

3. The toner according to claim 1, wherein a fixing rate of the strontium titanate particle in the toner is 55 to 95% by mass.

4. The toner according to claim 1, wherein xp (atomic %) is $0.05\leq xp\leq0.95$.

5. The toner according to claim 1, wherein the strontium titanate particle contained in the water-washed toner has a number average particle diameter of primary particle of 25 to 45 nm.

6. The toner according to claim 1, wherein a surface of the strontium titanate particle is hydrophobically treated.

7. The toner according to claim 6, wherein the surface of the strontium titanate particle is hydrophobically treated with a fluorine silane coupling agent.

8. The toner according to claim 1, wherein the strontium titanate particle has a volume resistivity of $2\times10^{9}$ to $2\times10^{13}$ Ω·cm.

* * * * *